United States Patent [19]

Takenoya et al.

[11] Patent Number: 4,522,138

[45] Date of Patent: Jun. 11, 1985

[54] METHOD OF PREPARING INTERCHARACTER CONTROL DATA FOR USE IN SEWING MACHINES

[75] Inventors: Hideaki Takenoya; Mikio Inamori, both of Tokyo, Japan

[73] Assignee: Janome Sewing Machine Industry Co., Ltd., Tokyo, Japan

[21] Appl. No.: 613,094

[22] Filed: May 22, 1984

[30] Foreign Application Priority Data

May 24, 1983 [JP] Japan ..... 58-89931

[51] Int. Cl.[3] ..... D05C 5/04

[52] U.S. Cl. ..... 112/266.1; 112/454

[58] Field of Search ..... 112/266.1, 102, 103, 112/158 E, 121.12, 262.1, 78

[56] References Cited

U.S. PATENT DOCUMENTS

| | | | |
|---|---|---|---|
| 4,266,493 | 5/1981 | Hanyu et al. | 112/158 E |
| 4,352,334 | 10/1982 | Childs et al. | 112/266.1 |
| 4,413,574 | 11/1983 | Hirota et al. | 112/158 E X |
| 4,416,209 | 11/1983 | Susumu | 112/266.1 |

*Primary Examiner*—Peter Nerbun

*Attorney, Agent, or Firm*—Frishauf, Holtz, Goodman and Woodward

[57] ABSTRACT

Intercharacter data for use in an electronic sewing machine is prepared by the steps of constituting each intercharacter control data with a first stitch control data group for determining relative position between a fabric and a character, a second stitch control data group utilized to form the character, and a third stitch control data group for determining a spacing between adjacent two characters; drawing a top segment $\alpha$ and a bottom segment $\beta$ respectively passing through top and bottom portions of the characters in parallel with the fabric feeding direction; and drawing a front segment X and a rear segment Y respectively passing through mostly projecting portions of the character on the front and rear sides thereof with respect to the fabric feeding direction in perpendicularly to the segments $\alpha$ and $\beta$. Then the needle position of a first stitch point effected by the first stitch control data group comes to a position near the segment X and the area (Sh') of a front blank portion bounded by a segment $X_0'$ passing through the first stitch point in parallel with the segment X, the contour of a character to be stitched next, and the segments $\alpha$ and $\beta$ is substantially the same between any two adjacent characters. Moreover, the area (St') of a rear blank portion bounded by a segment $Y_0'$ passing through a last stitch point provided by the third stitch control data group in parallel with the segment Y, the contour of a previously stitched character and the segments $\alpha$ and $\beta$ are also substantially the same between any two adjacent characters.

1 Claim, 14 Drawing Figures

METHOD OF PREPARING INTERCHARACTER CONTROL DATA FOR USE IN SEWING MACHINES

BACKGROUND OF THE INVENTION

This invention relates to a method of preparing character data of alphabets, numerical digits, Chinese characters, Japanese cursive syllabaries, etc. (hereinafter they are generally termed "characters") for use in a sewing machine, and more particularly to a method of preparing intercharacter control data for use in an electronically controlled sewing machine.

As a result of recent development of a computer sewing machine, the restriction upon stitching various patterns has been removed, and it has become possible to stitch various characters such as alphabets, Japanese cursive syllabaries and numerical digits which requires many complex stitches. Since these characters are memorized as stitch control data in the sewing machine, the sewing machine may be used to individually stitch initials of names and moreover, to stitch a plurality of characters in series in any desired combination of characters. When continuously producing a combination of characters, it is required that each letter should be well balanced with beautiful form as well as uniform spacing between two adjacent letters.

For example, as shown in FIG. 3, where a top segment $\alpha$ and a bottom segment $\beta$ which define a region to be traversed by the sewing machine needle, are drawn respectively passing through the top and bottom portions of respective characters in parallel with each other in the material feeding direction, and where front segment X and rear segment Y are drawn to pass mostly projecting front and rear ends respectively of the characters in perpendicular to the top and bottom segments $\alpha$ and $\beta$, the characters may be arranged as shown in FIG. 1, for example, with the spacing (a) between the front segments X maintained at a constant value. However, according to this method of arranging the characters, the spacing (r) between the rear segments Y of respective characters and the front segments X of the next characters would not be the same as shown in FIG. 1. Of course, such nonuniform arrangement of the characters is not preferable.

According to another method which obviates this defect, the spacing (b) between the rear segments Y of respective characters and the front segments X of the next characters may be made constant, as shown in FIG. 2. The arrangement of the characters according to this method is considerably improved over that according to the first mentioned method. However, the areas (x), which are dotted and bounded by the outsides or contours of respective characters and segments X, $\alpha$ and $\beta$ are different from the areas (y), which are dotted and horizontally lined, and bounded by segments Y, $\alpha$ and $\beta$ and the outsides or contours of respective characters. Therefore, when the characters are stitched with a reduced spacing (b) as shown in FIG. 2, the spacing between ornamental letter patterns C and A seems to be broader than the spacing between patterns B and C as shown in FIG. 3, which means unsatisfactory character arrangement.

SUMMARY OF THE INVENTION

Accordingly, it is an object of the invention to provide a novel method of forming an intercharacter control data for use in a sewing machine capable of making substantially equal the areas of intercharacter blank portions bounded by the rear contour of a preceeding character, the fore contour of the next character to be stitched and the top segment $\alpha$ and the bottom segment $\beta$, irrespectively of the types of combinations of different characters.

Another object of the invention is to provide a method of preparing an intercharacter control data for use in an electronic sewing machine capable of forming the initially stitched character at a position desired by the operator with respect to a material, thus enabling to stitch characters in a well balanced arrangement.

BRIEF DESCRIPTION OF THE DRAWINGS

The foregoing and further objects and advantages of the invention can be fully understood from the following detailed description when read in conjunction with the accompanying drawings in which:

FIGS. 1–3 illustrate typical examples of prior art character arrangements in which FIG. 1 shows the characters arranged with a constant spacing provided therebetween which is defined by the front end of the preceeding character and the front end of the next character; FIG. 2 shows the characters arranged with a constant spacing provided therebetween which is defined by the rear end of the preceeding character and the front end of the next character; and FIG. 3 is the characters so arranged as to explain the arrangements of characters in FIGS. 1 and 2;

FIGS. 4 through 14 show embodiments of the invention wherein FIG. 4 is an explanatory view for determining various segments and areas; FIG. 5 shows the character in a generalized form; FIGS. 6–8 show the diagrams in which respective elements of different characters are determined in the first stage of the embodiment; FIGS. 9 and 10 show the diagrams generalized to seek the elements of different characters in the second stage of the embodiment; FIGS. 11 and 12 show the diagrams seeking the elements of different characters in accordance with the invention; and FIGS. 13 and 14 show the diagrams of characters arranged in different combinations.

PREFERRED EMBODIMENTS OF THE INVENTION

The stitch control data for each character are constituted by a first stitch control data group utilized to determine the relative position between a character and a fabric to be sewn with the character, a second stitch control data group for forming the character, and a third stitch control data group for providing a spacing between the character and another character to be stitched next. At first, a top segment $\alpha$ and a bottom segment $\beta$ which respectively pass through the tops and bottoms of the character patterns designed as shown in FIG. 4, are drawn in parallel with the fabric feeding direction of a sewing machine and then front segment X and rear segment Y which respectively pass through the most projecting front and rear end of respective characters are drawn at right angles with respect to the fabric feeding direction to define the areas (x) and (y) of the blank portions in the forward and rearward of the characters respectively in the fabric feeding direction.

Figure 1:
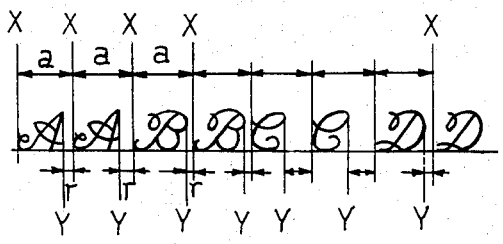
FIG. 1 PRIOR ART
Figure 2:
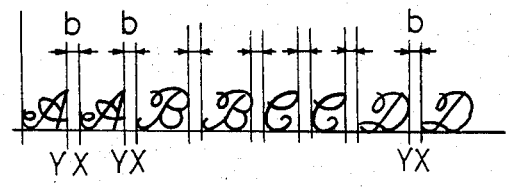
FIG. 2 PRIOR ART
Figure 3:
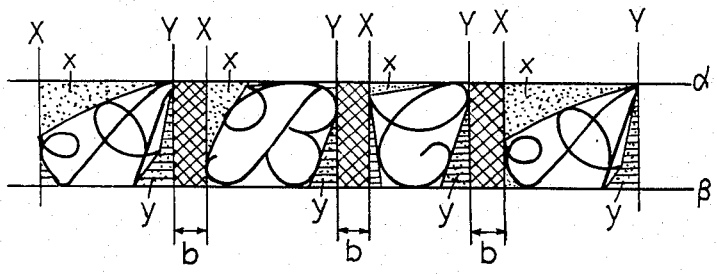
FIG. 3 PRIOR ART
Figure 4:
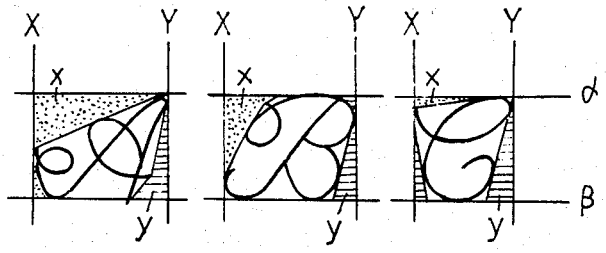

Areas (x) and (y) of the blank portions are determined by interconnecting two points projecting outwardly of each character as shown in FIG. 4. Where there are no projecting two points (like a right upper corner of the ornamental letter B) a tangent making an angle 45° with respect to the horizontal is drawn, while a small portion as the left lower corner of the ornamental letter B is neglected. A portion bounded by a line interconnecting forwardly projecting points of each character, front segment X, top segment $\alpha$ and bottom segment $\beta$ is the blank portion (x), while a portion bounded by a line interconnecting rearwardly projecting points of each character, rear segment Y, top segment $\alpha$ and bottom segment $\beta$ is the blank portion (y).

Figure 5:
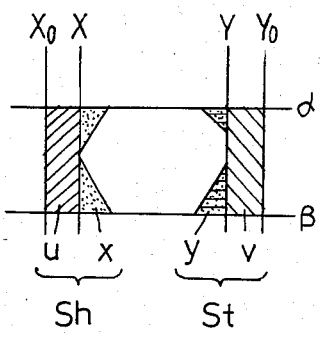

Then, as shown in FIG. 5, a segment $X_0$ passing through a first needle dropping point (not shown) determined by the first data of the first stitch control data group is drawn in parallel with the front segment X. The area of a portion bounded by segments $X_0$, X, $\alpha$ and $\beta$ is denoted by (u). Then a segment $Y_0$ passing through the last needle dropping point (not shown) determined by the last data of the third stitch control data group is drawn in parallel with the rear segment Y, and the area of a portion bounded by segments Y, $Y_0$, $\alpha$ and $\beta$ is denoted by (v). The sum of the areas (u) and (x) of the blank portions corresponds to the area (Sh) of the front blank portion of a character, while the sum of areas (y) and (v) of the blank portions represents the area (St) of the rearward blank portion of the character. The sum of the areas (Sh) and (St) corresponds to the area (S) of the intercharacter blank.

Areas (x) and (y) of the blank portions will differ in respective characters. For making constant the area (S) of the intercharacter blank, and for preventing the rear segment Y of a character from overlapping the front segment X of another character to be stitched next, the areas (Sh) and (St) should satisfy the following equations:

$$(Sh)=(u)+(x)=(x_0)\geqq(x_{max})$$

$$(St)=(y)+(v)=(y_0)\geqq(y_{max})$$

where $(x_{max})$ denotes the maximum value of (x), and $(y_{max})$ the maximum value of (y), and $(x_0)$ and $(y_0)$ are constants. Then the results $(u)\geqq 0$ and $(v)\geqq 0$ will satisfy the conditions to be sought. In this case, $$(S)=(Sh)+(St)=(x_0)+(y_0)\geqq(x_{max})+(y_{max})$$

Figure 6:
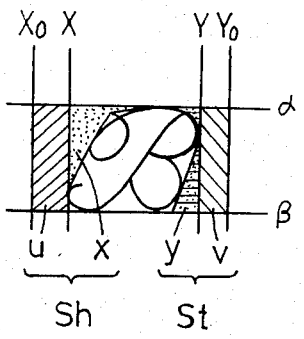
Figure 7:
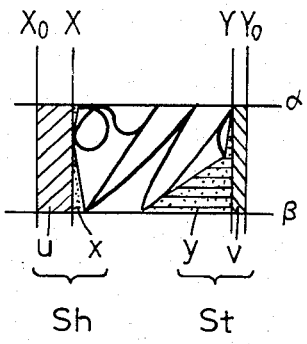
Figure 8:
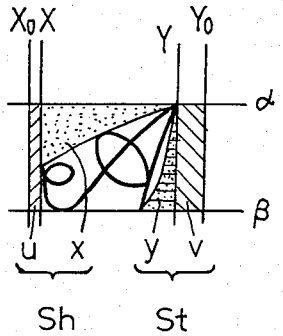

FIGS. 6 through 8 show examples seeking the segments $X_0$ and $Y_0$ that will give areas (u) and (v), in dependence upon the blank portion areas (x) and (y).

FIG. 7 shows an example in which $(x)=(x_{max})$. In this case, (u) becomes the maximum value $(u_{max})=(x_0)-(x_{min})$. FIG. 8 shows an example in which $(x)=(x_{max})$. In this case, (u) becomes the minimum value $(u_{min})=(x_0)-(x_{max})$.

The second stage of the method of the invention is to provide the intercharacter control data, which will be described as follows. According to the first stage of the method described above, in any case, segment X passing through the most forwardly projecting end of a character stitched by the second stitch control data group is located rearwardly of the segment $X_0$ passing through the first needle dropping point provided by the first stitch control data group, though two segments X and $X_0$ may coincide with each other in the case of $(x_0)=(x_{max})$. In the actual case, however, the position of the front end (segment X) of a character will be variable with reference to the loading point (segment $X_0$) so that it is difficult to accurately determine the position of the character to be firstly stitched with reference to the fabric.

Taking the above fact into consideration, in the second stage of the method, segment $X_0$ is moved a certain amount toward segment X (or beyond segment X) and then segment $Y_0$ is displaced the same amount rearwardly of segment Y, so as to displace so much the initial stitch of the character which is to be made by the first stitch control data group, thus reducing to the minimum the positioning errors of each character when the character is initially stitched.

In this embodiment, since $(u_{max})=(x_0)-(x_{min})$ and $(u_{min})=(x_0)-(x_{max})$, the above described displacement amount of segments $X_0$ and $Y_0$ may be determined by dividing $\frac{1}{2}[(u_{max})-(u_{min})]$, that is $\frac{1}{2}[(x_{max})-(x_{min})]$ with the spacing between segments $\alpha$ and $\beta$.

Let us denote by C the decrement in the area of the blank portion (u) caused by the displacement amount of segments $X_0$ and $Y_0$. Then, in the case of $(u_{max})$, the following equation holds:

$$(x_0)-(x_{min})-C=\tfrac{1}{2}[(x_{max})-(x_{min})]$$

so that we obtain:

$$C=(x_0)-\tfrac{1}{2}[(x_{max})+(x_{min})]$$

In the following, let us prove the fact that the area of the intercharacter blank portion S of a combination of characters will not vary with the displacement of segments $X_0$ and $Y_0$.

Figure 9:
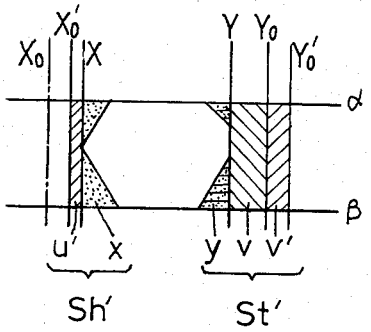

In FIGS. 5, 8 and 9, assuming that due to the displacement of segments $X_0$ and $Y_0$ over the definite amount, segments $X_0$ and $Y_0$ become $X_0'$ and $Y_0'$ respectively, and that the areas (St) and (Sh) of the blank portions are changed to (St') and (Sh') respectively, we obtain:

$$(St')=(y)+(v)+(v')=(S)-(x_0)+C$$

where $C=(x_0)-\frac{1}{2}[(x_{max})+(x_{min})]$. This means that the area (St') of the blank portion becomes constant between respective characters.

Figure 10:
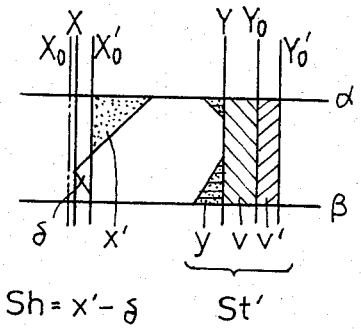

As shown in FIG. 9, when $C<(v)$, the area (Sh') of the blank portion is expressed by the following equation:

$$(Sh')=(u')+(x)=(x_0)-C$$

whereas when $C>(v)$, as shown in FIG. 10, where the area of the character cut off by the segment $X_0'$ is denoted by $\delta$ which decreases the area of the blank portion of the character, we obtain:

$$(Sh')=(x')-\delta=(u)+(x)-C=(x_0)-C$$

As above described, since the area (Sh') of the blank portion is expressed by $(Sh')=(x_0)-C$, even if $C\leqq(v$(or $C>(v)$. In other words, the area (Sh') is constant between any two adjacent characters. Consequently, the area S of the intercharacter blank portion which is the sum of blank portions (St') and (Sh') is also constant.

Figure 11:
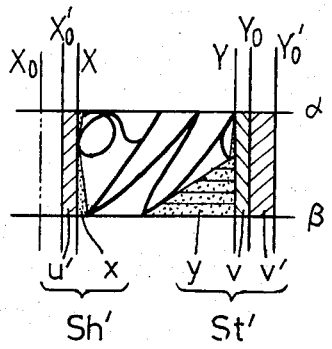
Figure 12:
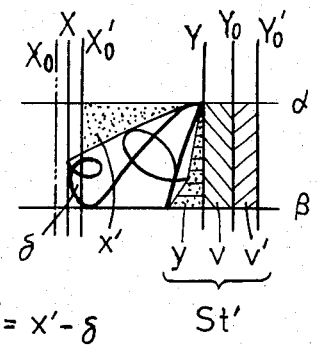
Figure 13:
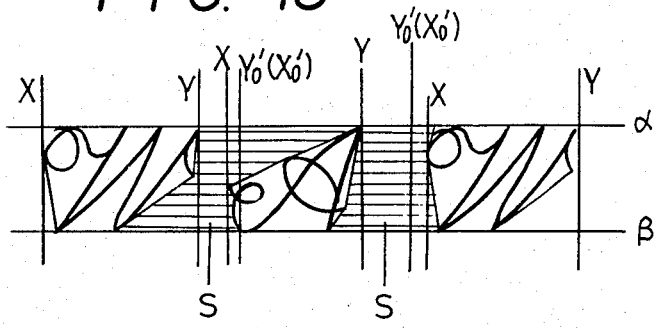
Figure 14:
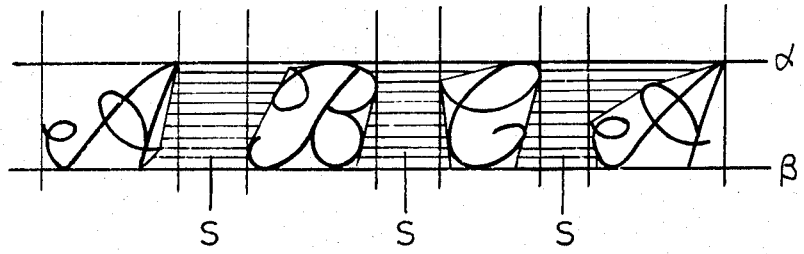

FIGS. 11 and 12 show the diagrams with the segments $X_0'$ and $Y_0'$ obtained by the method of preparing character control data according to the first and second stages described above. FIGS. 13 and 14 show examples of character patterns including the characters shown in FIGS. 11 and 12 respectively and stitched in series.

In summary, this invention relates to a method of preparing data to produce the characters such as alphabets, numerical digits and Japanese cursive syllabaries, etc. by controlling the needle position and the fabric feeding amount of the sewing machine. Each unit of data is composed of a first stitch control data group for determining the relative position of a character and the fabric, a second stitch control data group for forming the character, and a third stitch control data group for determining a spacing between the character and another character to be stitched next. With regard to the patterns stitched according to the character data, a top segment $\alpha$ and a bottom segment $\beta$ may be drawn in parallel passing through the top and bottom of each character and in parallel with the fabric feeding direction, and front and rear segments X and Y may be drawn respectively passing through the most forwardly and rearwardly projecting ends of the character in the fabric feeding direction and intersecting with each other. Then the character pattern has an initial stitch formed by the first stitch control data group positioned close to the segment X, and the area (Sh') of the front blank portion bounded by a segment passing through the first stitch point in parallel with the segment X, the contour of the character stitched next by the second stitch control data group, and segments $\alpha$ and $\beta$ becomes substantially equal all through the other different characters each adjacently formed. Furthermore, the area (St') of the rear blank portion bounded by a segment passing through the last stitch point formed by the third stitch control data group in parallel with the segment Y, the contour of a previously stitched character, and segment $\alpha$ and $\beta$ also becomes substantially equal all through the other different characters each adjacently formed. Consequently, when a combination of characters is stitched, the area S of the intercharacter blank portion, which is the sum of the areas (Sh') and (St') of the blank portions, is substantially constant, thus enabling the operator to stitch the characters of preferred arrangement and correctly position the firstly stitched character as the operator desires with respect to the fabric.

As above described, according to the invention, it is possible to make substantially constant the area of the intercharacter spacing bounded by the rear contour of a character, the front contour of another character to be stitched next, and the top and bottom segments $\alpha$ and $\beta$, irrespective of any combinations of dfferent characters. Moreover, the firstly stitched character may be always formed at a position desired by the operator with respect to the fabric. Accordingly, it is possible to stitch characters of balanced arrangement.

While the invention has been described in conjunction with a preferred embodiment thereof, it is to be understood that many different variations and modifications may be made without departing from the spirit and scope of the invention.

What is claimed is:

1. A method of preparing intercharacter control data for use in combination with an electronic sewing machine for controlling a needle position and a fabric feed amount to produce a series of character patterns, which comprises the steps of:

providing the intercharacter control data, each of which being composed of a first stitch control data group for producing an initial stitch to determine the position of a character relative to a fabric in which the character is stitched, a second stitch control data group for forming the character and a third stitch control data group for producing stitches to determine a spacing between the character and the next character to be stitched adjacent thereto, said first, second and third stitch control data group being provided in relation with a top segment ($\alpha$) and a bottom segment ($\beta$) respectively passing the top and bottom ends of the character in parallel with the fabric feeding direction, and a front segment (X) and a rear segment (Y) respectively passing through the mostly projecting front and rear ends of the character at the right angles with the fabric feeding direction;

providing said first stitch control data group to produce the initial stitch at a position close to said front segment (X);

providing said second stitch control data group to produce said character having at least the front and rear contours, said front contour defining a substantially predetermined constant blank area (Sh') together with said top and bottom segments ($\alpha$,$\beta$) and a second front segment ($X_0$') which is drawn passing said initial stitch in parallel with said front segment (X) and at right angles with the fabric feeding direction; and providing said third stitch control data group to produce said space determining stitches, the last stitch of which defining a substantially predetermined constant area (St') together with said top and bottom segments ($\alpha$, $\beta$), said rear contour of the character and a second rear segment ($Y_0$') which is drawn passing through said last stitch in parallel with said rear segment (Y) and at right angles with the fabric feeding direction.

* * * * *